US010352188B2

(12) United States Patent
Shin et al.

(10) Patent No.: US 10,352,188 B2
(45) Date of Patent: Jul. 16, 2019

(54) CENTRIFUGAL TURBO MACHINE HAVING STRETCHABLE AND VARIABLE DIFFUSER VANE

(71) Applicant: KOREA INSTITUTE OF SCIENCE AND TECHNOLOGY, Seoul (KR)

(72) Inventors: You Hwan Shin, Seoul (KR); Joo Hoon Park, Seoul (KR); Young Soo Kim, Seoul (KR)

(73) Assignee: Korea Institute of Science and Technology, Seoul (KR)

( * ) Notice: Subject to any disclaimer, the term of this patent is extended or adjusted under 35 U.S.C. 154(b) by 141 days.

(21) Appl. No.: 15/696,331

(22) Filed: Sep. 6, 2017

(65) Prior Publication Data

US 2018/0283198 A1 Oct. 4, 2018

(30) Foreign Application Priority Data

Mar. 28, 2017 (KR) ..... 10-2017-0039273

(51) Int. Cl.
*F01D 17/24* (2006.01)
*F01D 17/16* (2006.01)
*F01D 5/04* (2006.01)

(52) U.S. Cl.
CPC ..... *F01D 17/165* (2013.01); *F01D 5/04* (2013.01); *F01D 17/24* (2013.01)

(58) Field of Classification Search
None
See application file for complete search history.

(56) References Cited

U.S. PATENT DOCUMENTS 3,188,505 A * 6/1965 Wiley ..... H02K 1/16 29/605
3,953,150 A * 4/1976 Onal ..... F04D 1/006 416/184
6,361,270 B1 * 3/2002 Bennett ..... F04D 1/10 415/143
8,632,302 B2 * 1/2014 Sorokes ..... F04D 29/444 415/161
2002/0076328 A1 * 6/2002 Kocian ..... B23P 15/04 416/235
2004/0240990 A1 * 12/2004 Rockley ..... F01D 17/162 415/148
2008/0076619 A1 * 3/2008 Scott ..... F04D 9/02 475/300
2016/0061039 A1 * 3/2016 Herbruck ..... F01C 1/324 418/142
2016/0123345 A1 * 5/2016 Scotti Del Greco ... F04D 29/30 415/208.1
2016/0326896 A1 * 11/2016 Jamison ..... F01D 5/284

FOREIGN PATENT DOCUMENTS

KR 10-0813145 B1 3/2008

* cited by examiner

*Primary Examiner* — Michael Lebentritt
(74) *Attorney, Agent, or Firm* — Rabin & Berdo, P.C.

(57) ABSTRACT

The present disclosure is relates to a centrifugal turbo machine equipped with stretchable and variable diffuser vanes capable of securing further improvement of compression efficiency by reducing an angle of the vane and increasing a length of the vane using forced rotating driving of a diffuser during operation of a compressor so as to reduce frictional loss of the fluid when a flow rate of fluid is reduced.

6 Claims, 7 Drawing Sheets

CENTRIFUGAL TURBO MACHINE HAVING STRETCHABLE AND VARIABLE DIFFUSER VANE

CROSS-REFERENCE TO RELATED APPLICATION

This application claims the benefit of Korean Patent Application No. 2017-0039273, filed on Mar. 28, 2017 in the Korean Intellectual Property Office, the disclosure of which is incorporated herein by reference.

BACKGROUND

1. Field of the Invention

The present disclosure relates to a centrifugal turbo machine having a stretchable and variable diffuser vane, and more particularly, to a centrifugal turbo machine having a stretchable and variable diffuser vane moved by high-speed rotational motion of an impeller like a turbo compressor, a turbo blower, a turbo fan, or the like so that fluid flows and static pressure increases.

2. Description of the Related Art

In general, a turbo machine is a machine that can move or compress fluid through high-speed rotational motion. In this machine, high-speed rotation is realized by using a subordinate gear coupled to a motor which is rotated at constant speed. However, recently, due to a development of a bearing and an inverter, a technique in which an impeller is directly connected to a motor is applied to allow the impeller to be rotated at high speed.

FIG. 1 is a view schematically illustrating one example of a centrifugal compressor among conventional turbo machines. The centrifugal compressor includes an impeller 10 coupled to a driving shaft 1 and having a plurality of blades 11 formed in a circumferential direction, a diffuser 20 provided on an outer side of the impeller 10 to convert kinetic energy of fluid increased by rotation of the impeller 10 into static pressure, and a plurality of vanes 30 formed in a circumferential direction of the diffuser 20 to guide a flow of the working fluid.

When the impeller 10 is rotated, the fluid is suctioned into a casing. The suctioned fluid is sequentially passed through the impeller 10, the diffuser 20, and the vanes 30, and is then discharged to an outlet of the centrifugal compressor. In this process, the impeller 10 accelerates the fluid in a centrifugal direction, and the plurality of vanes 30 decelerate the fluid accelerated by the impeller 10. The accelerated fluid is decelerated while being passed through a fluid path between the vanes 30. At this time, velocity energy of the fluid is converted into pressure energy, so that the static pressure of the fluid is increased in diffuser flow path.

One of the important design parameters in the centrifugal compressor is an angle of the vane 30.

However, since a general centrifugal compressor has a structure in which a location (angle) of the vane 30 is fixed, optimal compression efficiency can be expected in a certain load operation, on the other hand, there is a problem in that performance and compression efficiency are lowered under another load operation.

Accordingly, in order to solve such a problem, as shown in FIG. 2, the variable vane 30 whose angle with respect to the impeller 10 is adjustable is applied to the conventional centrifugal compressor.

The variable vane 30 is rotatably installed by a hinge shaft 31 and is rotatable in both directions.

When the variable vane 30 is rotated by a certain angle, an area of the fluid path between the neighboring vanes 30 is changed. In other words, the area of the fluid path is increased or decreased according to the rotational direction of the variable vane 30.

When a flow rate of the fluid is reduced, the absolute flow angle at the outlet of the impeller becomes small due to operation characteristics of the centrifugal compressor. At this time, the angle of the vane 30 is adjusted.

However, when the angle of the vane 30 is adjusted at a low flow rate, the angle of the vane 30 is reduced, and a gap between the vane 30 and a wall surface, that is, a vaneless region, is increased at the outlet side of the diffuser 20. Therefore, the fluid strikes the wall surface of the outlet side of the diffuser 20, so that an unnecessary friction phenomenon occurs. As a result, there is a problem in that the improved compression efficiency cannot be ensured.

The vane 30 is formed as an angle-converting mechanism having one hinge shaft 31 for guiding a flow of the fluid. Each vane 30 is installed so as to form a predetermined angle with a central direction of the impeller 10 and has an airfoil shape.

However, since the conventional centrifugal compressor includes the vane 30 having only one hinge shaft 31, there is a problem in that the vane cannot withstand strong torque generated from the fluid which is discharged at high-speed from the impeller 10.

SUMMARY OF THE INVENTION

The present disclosure is directed to providing a centrifugal turbo machine equipped with stretchable and variable diffuser vanes capable of securing further improvement of compression efficiency by reducing an angle of the vane and increasing a length of the vane using forced rotating driving of a diffuser during operation of a compressor so as to reduce frictional loss of the fluid when a flow rate of fluid is reduced.

The present disclosure is also directed to providing a centrifugal turbo machine equipped with a stretchable variable diffuser vane capable of withstanding a strong torque caused by fluid discharged at high-speed from an impeller.

In accordance with one aspect of the present disclosure, a centrifugal turbo machine having stretchable and variable diffuser vanes includes an impeller including a hub and a plurality of blades and rotatably installed at a center of an interior of a casing; a diffuser provided on an outer side of the impeller and configured to convert kinetic energy of fluid increased by rotation of the impeller into static pressure; a rotating ring section provided on and facing an outer side of the diffuser in a ring shape and configured to be rotatable about the impeller; a plurality of vanes disposed between an inlet side and an outlet side of the diffuser with respect to a flow of fluid, spaced apart from each other in a circumferential direction to define flow paths therebetween, and each configured to adjust an angle thereof to change an area of the flow path according to a moving direction thereof; and a power transmitting section configured to generate power and transmit the power to the rotating ring section so that the rotating ring section is rotated about the impeller, wherein the vane includes two hinge shafts formed at both ends thereof and a connecting portion connecting the hinge shafts, and at least a part of the connecting portion is made of a ductile material so that a length of the connecting portion is elastically variable.

The connecting portion may have a closed loop structure that is elastically wound around the hinge shafts.

The vane may further include a spacer inserted between and fixed to opposite sides of the connecting portion to uniformly maintain a distance between the opposite sides of the connecting portion.

One hinge shaft of the hinge shafts may be rotatably fixed to the inlet side of the diffuser and the other hinge shaft may be rotatably fixed to the rotating ring section.

The power transmitting section may include a step motor; a first element provided on a motor shaft of the step motor; a second element installed at one side of the rotating ring section and engaged with the first element to provide the rotating ring section with rotational power through an interaction with the first element; and a controller configured to control driving of the step motor.

The first element may be a pinion gear and the second element may be a rack gear.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION OF THE EXEMPLARY EMBODIMENTS

Figure 1:
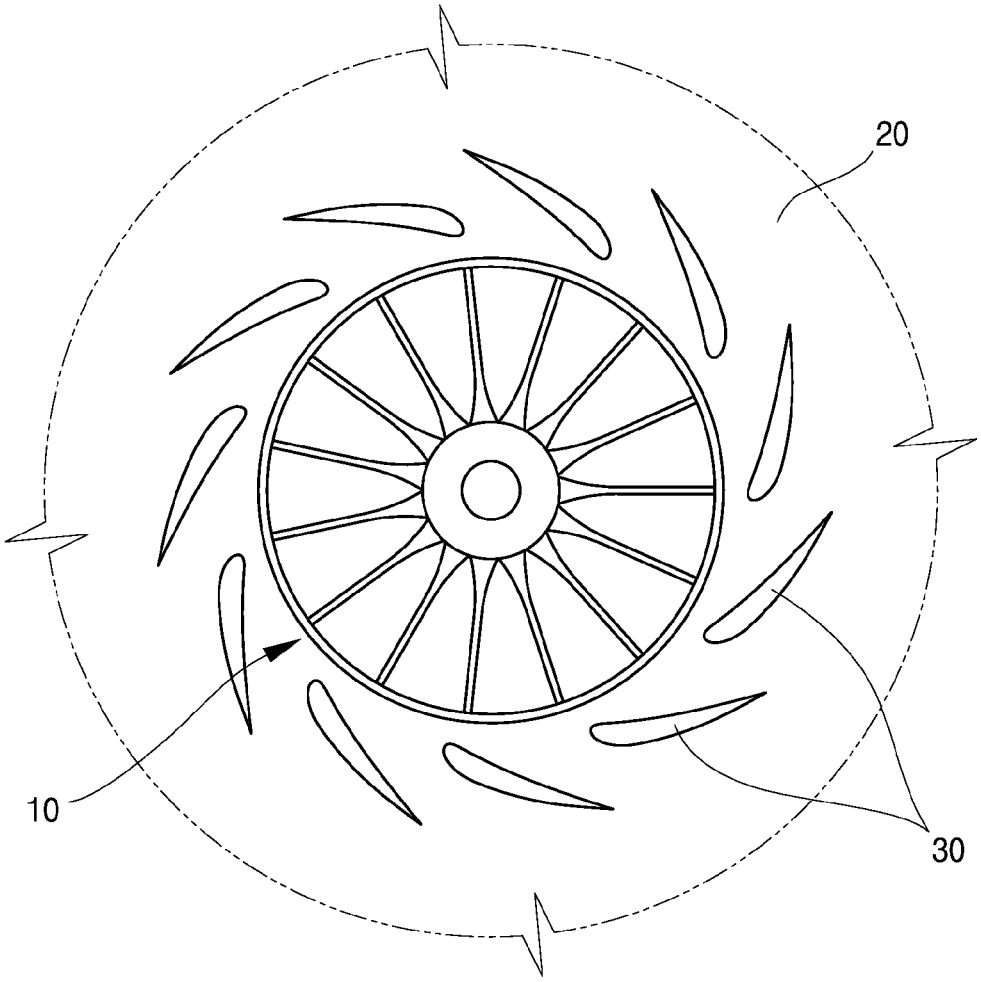
FIG. 1 (Prior Art)
FIG. 1 is a conceptual view showing a centrifugal compressor according to a conventional art.
Figure 2:
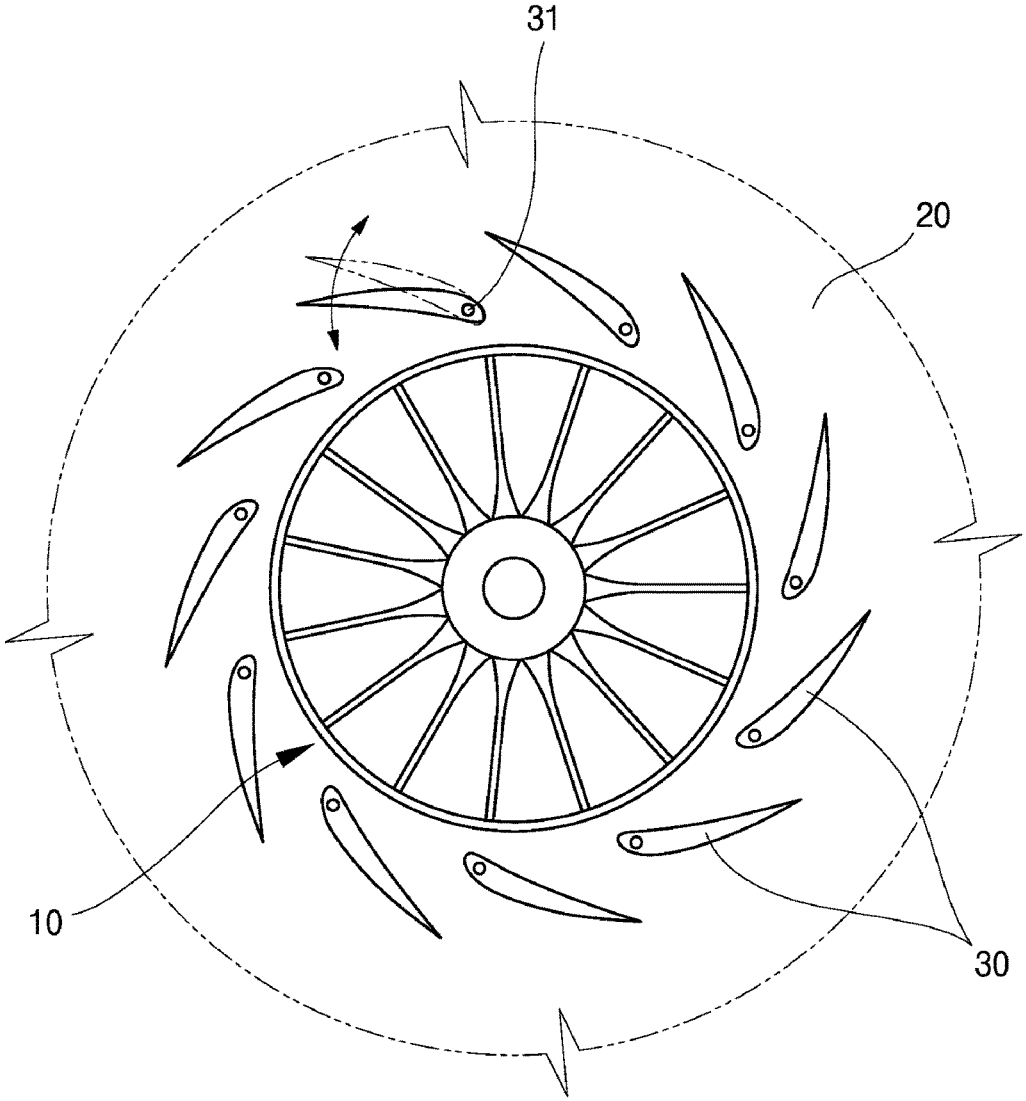
FIG. 2 (Prior Art)
FIG. 2 is a conceptual view showing a centrifugal turbo machine having a stretchable and variable diffuser vane according to a conventional art.
Figure 3:
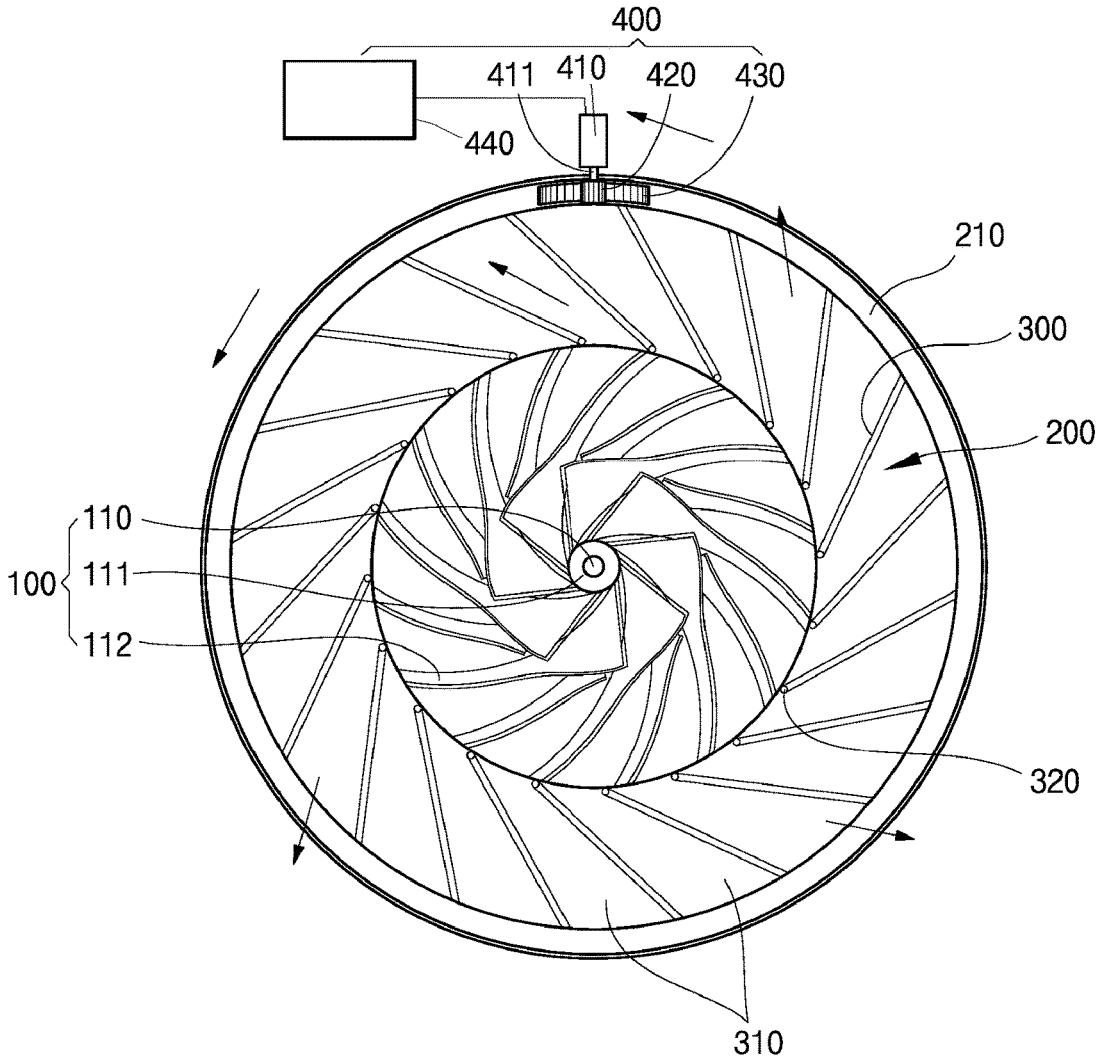
FIG. 3 is a cross-sectional view of a centrifugal turbo machine having a stretchable and variable diffuser vane according to the present disclosure.
Figure 4:
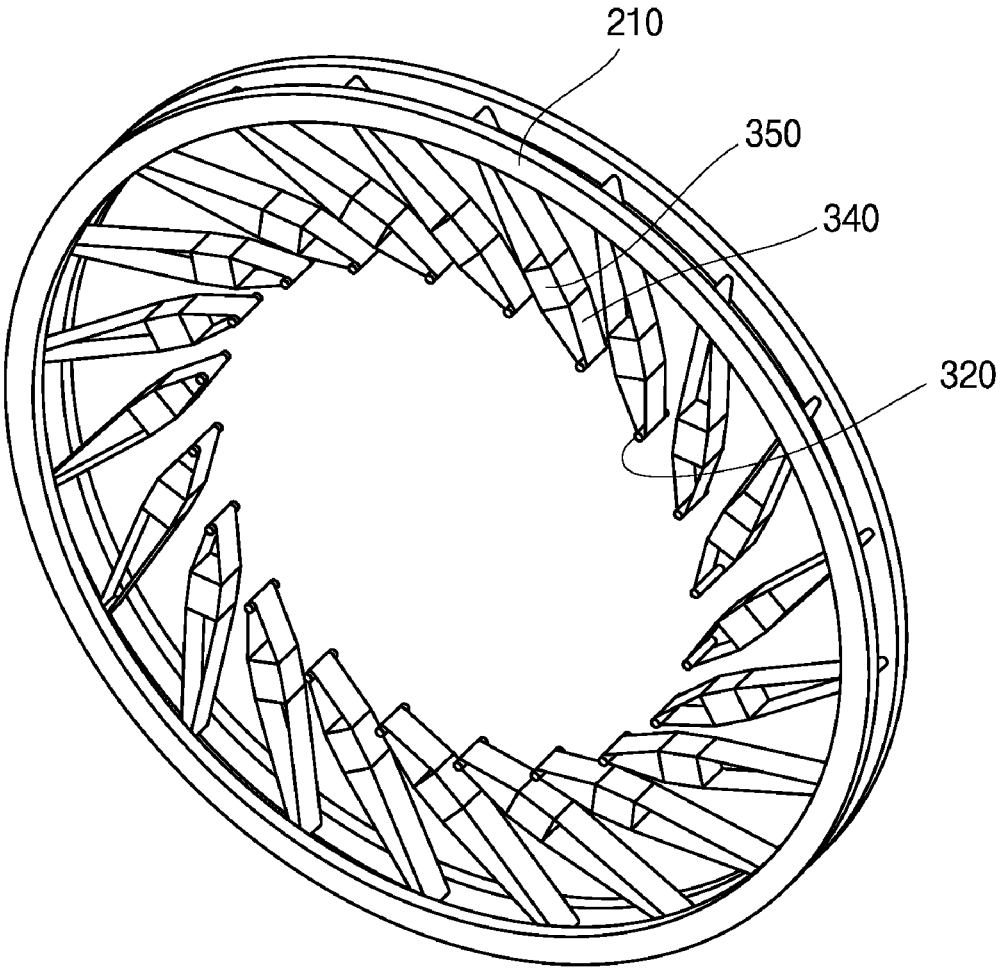
FIG. 4 is a view showing a rotational ring section and vanes of the centrifugal turbo machine according to the present disclosure.

Exemplary embodiments of the present invention will be described in detail below with reference to the accompanying drawings. While the present invention is shown and described in connection with exemplary embodiments thereof, it will be apparent to those skilled in the art that various modifications can be made without departing from the spirit and scope of the invention.

Hereinafter, a preferred embodiment of the present disclosure is described in detail with reference to FIGS. 3 to 8.

In a centrifugal turbo machine having a stretchable and variable diffuser vane according to the present disclosure, an impeller 100 consisting of a hub 111 and a plurality of blades 112 is provided at a center portion of an inside of a casing.

An impeller shaft 110 is rotatably installed in the impeller 100, the hub 111 is mounted on the impeller shaft 110, and the plurality of blades 112 are mounted on an outer side of the hub 111 and spaced apart from each other at regular intervals.

The impeller shaft 110 is rotated by a shaft driving device such as a motor, and when the impeller shaft 110 is rotated, the hub 111 and the blades 112 are rotated together.

In this process, fluid introduced into the casing is accelerated in a radial direction by the rotating impeller 100 and is then discharged to an outlet of the centrifugal turbo machine located at an outer side the impeller 100.

A diffuser 200 configured to reduce a velocity of the fluid from the impeller 100 for converting kinetic energy of the fluid into pressure energy is provided on an outer side of the impeller 100, and a plurality of vanes 300 are disposed in a circumferential direction of the diffuser 200 to guide a flow of the working fluid.

The vanes 300 are disposed to be spaced apart from each other at equidistant intervals in the circumferential direction with respect to the impeller shaft 110, and fluid paths 310 are formed between the vanes 300.

The vane 300 according to the embodiment of the present disclosure includes two hinge shafts 320 and 330 formed at both ends thereof and a linear connecting portion 340 connecting the hinge shafts 320 and 330.

In the embodiment of the present disclosure, the connecting portion 340 has a closed loop structure that is elastically wound around the hinge shafts 320 and 330.

Between the hinge shafts 320 and 330, the connecting portion 340 is tightly pulled to be maintained in a state of tension. At this time, the connecting portion 340 may include at least one portion formed of a ductile material 341 so as to allow the connecting portion to flexibly surround the hinge shafts 320 and 330 as well as to elastically adjust a length thereof. Here, rubber may be employed as the ductile material 341.

Figure 5:
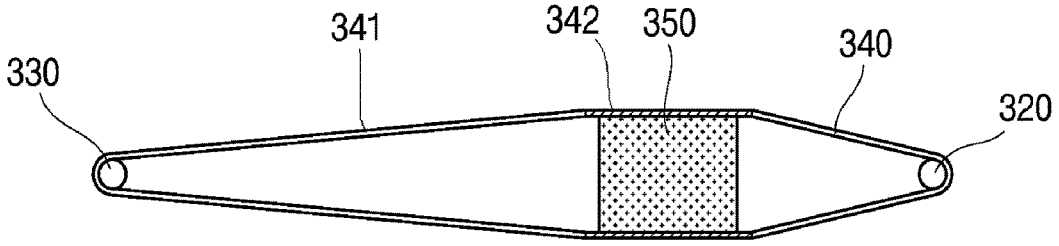
FIG. 5 is a cross-sectional view showing a shape of a vane of a centrifugal turbo machine according to one embodiment of the present disclosure.

The connecting portion 340 does not have to be entirely formed of the ductile material 341 in order to adjust a length of the vane 300. In the connecting portion 340, as shown in FIG. 5, all or a part of portions surrounding the hinge shafts 320 may be formed of the stretchable ductile material 341, and the remaining portion may be formed of a rigid material 342. In other words, even when only a portion surrounding at least one of the hinge shafts 320 and 330 is formed of the ductile material 341, there is no problem in adjusting the length of the connecting portion 340.

Figure 6:
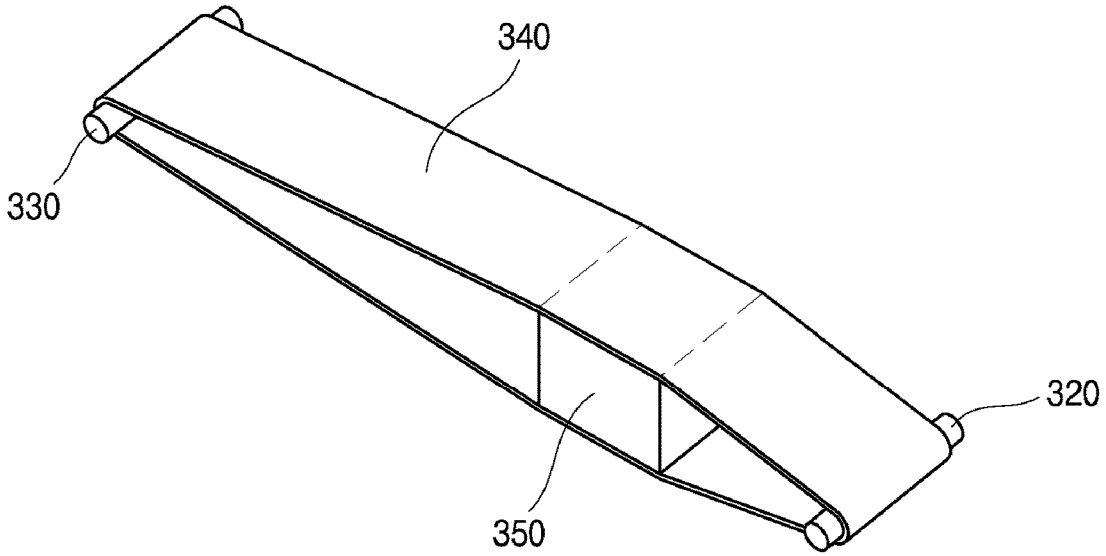
FIG. 6 is a view showing a shape of a vane of a centrifugal turbo machine according to another embodiment of the present disclosure.

As shown in FIGS. 5 and 6, a spacer 350 may be inserted between and fixed to opposite sides of the connecting portion so as to uniformly maintain a distance between the opposite sides of the connecting portion 340.

By fixing the spacer 350 between the opposite sides of the connecting portion 340 as described above, it is possible to form a streamlined vane 300 by which lifting force can be maximized and drag force can be minimized.

A thickness and a shape of the spacer 350 may vary to allow the lifting force and the drag force to be appropriately adjusted.

In addition, the spacer 350 is placed at a location adjacent to an inlet side of the diffuser 200 so that the vane 300 may have a streamlined shape.

In order to allow the shape of the vane 300 to be adjusted, the spacer 350 may be formed in a spherical shape, a hexahedral shape, or the like. In addition to the above-described embodiment, the spacer may be implemented in various other forms.

Figure 7:
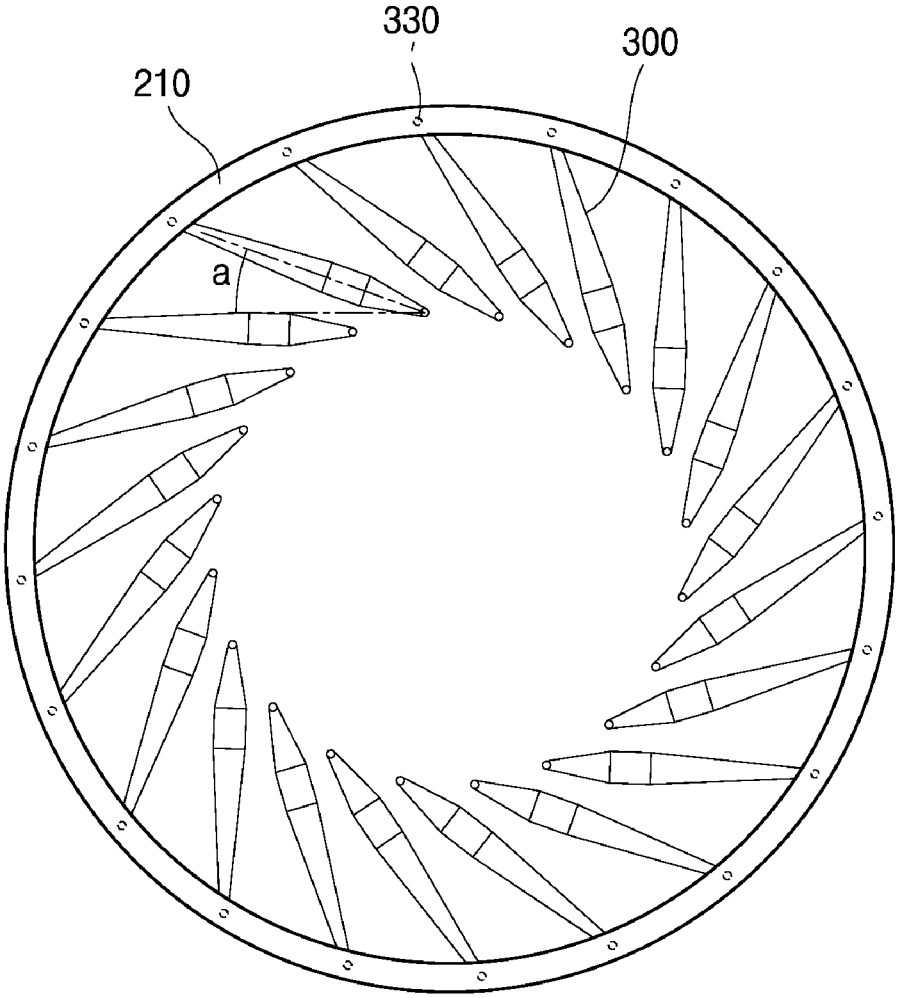
FIGS. 7 and 8 are views showing a state, in which the centrifugal turbo machine having stretchable variable diffuser vanes is being used, and showing a change in an angle of the stretchable variable diffuser vane.
Figure 8:
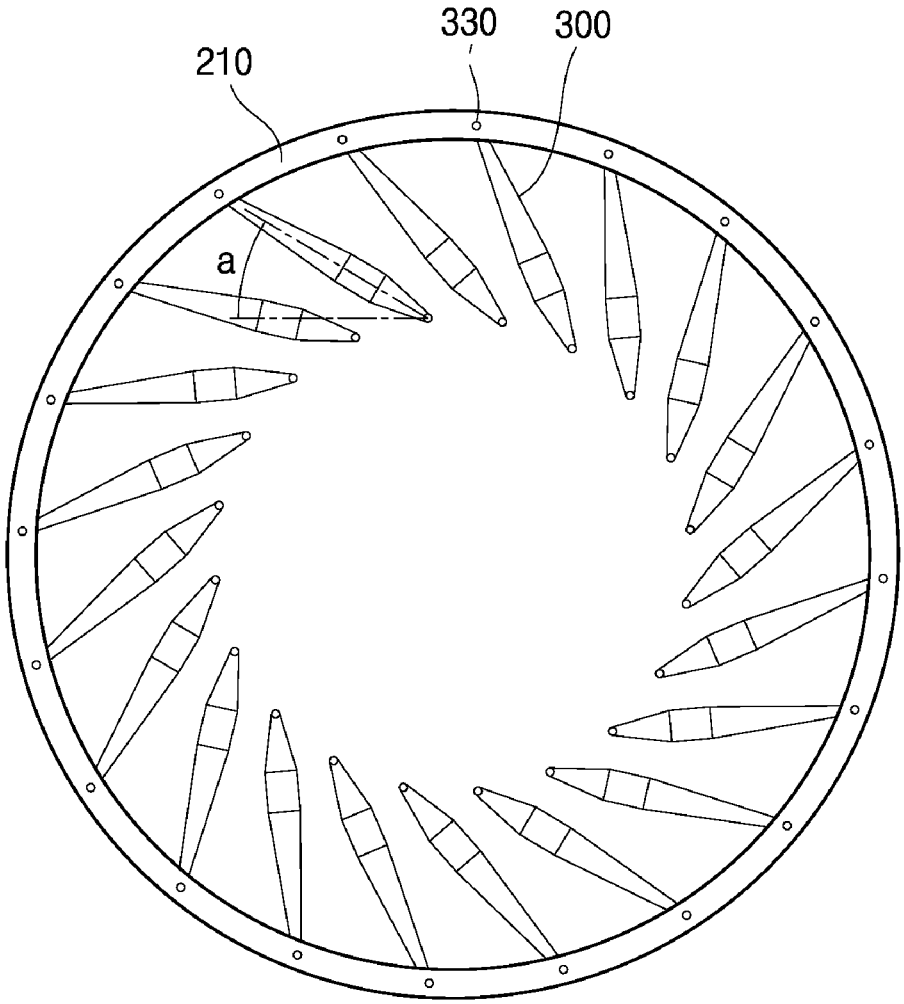

As shown in FIGS. 7 and 8, an angle $\alpha$ of the vane 300 is determined according to a flow rate of the fluid discharged from the impeller 100.

When the flow rate of the fluid flowing in the centrifugal turbo machine is relatively low, the angle α of the vane 300 is reduced (see FIG. 7), and when the flow rate of the fluid is relatively high, the angle α of the vane 300 is increased (see FIG. 8). It goes without saying that the length of the vane 300 is relatively increased when the angle α of the vane 300 is decreased.

Meanwhile, a rotating ring section 210 is installed on and faces an outer side of the diffuser 200 in a ring shape and is rotatable about the impeller 100. The hinge shafts 330 of the vanes 300 are rotatably fixed to the rotating ring section 210.

One hinge shaft 320 of the hinge shafts 320 and 330 provided at both ends of the vane 300 is rotatably fixed at the inlet side of the diffuser 200, and the other hinge shaft 330 is rotatably fixed to the rotating ring section 210 installed at an outlet side of the diffuser 200.

The rotating ring section 210 is configured to be rotatable about the impeller 100. When the rotating ring section 210 rotates about the impeller 100, the hinge shaft 330 which is rotatably fixed to the rotating ring section 210 is rotated with respect to the hinge shaft 320, which is fixed to the inlet side of the diffuser 220, in a direction in which the rotating ring section 210 rotates so that a distance between the hinge shafts 320 and the 330, that is, the length of the connecting portion 340, may be changed. In other words, when the flow rate of the fluid flowing in the centrifugal turbo machine is low and when the angle α of the vane 300 is decreased to reduce the area of the fluid path 310, the length of the connecting portion 340 of the vane 300 is increased with respect to the hinge shaft 320 fixed to the inlet side of the diffuser 200.

This is correlated with the material of the vane 300, and as the rotating ring section 210 is rotated, the hinge shaft 330 pulls the connecting portion 340, so that the connecting portion 340 is elastically stretched and a length thereof is increased.

Meanwhile, a power transmitting section 400, which is configured to generate power and transmit the power to the rotating ring section 210 so that the rotating ring section 210 is rotated to change the angle α of the vane 300, includes a step motor 410, a first element 420 provided on a motor shaft 411 of the step motor 410, a second element 430 installed at one side of the rotating ring section 210 and engaged with the first element 420 to provide the rotating ring section 210 with rotational power through an interaction with the first element, and a controller 440 configured to control driving of the step motor 410. Here, the first element 420 is a pinion gear, and the second element 430 is a rack gear.

The rack gear is installed at one side of the rotating ring section 210, and a length thereof corresponding to the maximum rotational angle of the vane 300 is determined.

The motor shaft 411 of the step motor 410 is provided at an outer side of the rotating ring section 210 so that the pinion gear meshes with the rack gear in a perpendicular direction, and an end portion of the motor shaft is press-fitted into a center of the pinion gear in an axial direction so that the motor shaft is rotated integrally with the pinion gear.

Since a load applied to the step motor 410 is not large when the rotating ring section 210 is rotated, a small motor having a small capacity may be employed as the step motor 410, and the motor shaft 411 of the step motor 410 may be rotated as much as the predetermined angle α of the vane 300 in a state of supplying power.

The power transmitting section 400 of the rotating ring section 210 may consist of a warm and a worm gear instead of the rack gear and the pinion gear.

Furthermore, in addition to the above-described embodiment, the power transmitting section 400 of the rotating ring section 210 is not necessarily limited thereto and may be implemented in various other forms.

According to the centrifugal turbo machine equipped with the stretchable and variable diffuser vane according to the present disclosure having the above-described structure, by reducing an angle of the vane and increasing a length of the vane through a forced rotating driving of the diffuser during operation of a compressor in which a flow rate is reduced, it is possible to secure improved compression efficiency by fundamentally preventing frictional loss of fluid from occurring in a vaneless region.

In addition, the centrifugal turbo machine of the present disclosure includes a power transmitting section capable of forcibly rotating a diffuser to smoothly adjust a rotational angle of a vane.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

What is claimed is:

1. A centrifugal turbo machine having stretchable and variable diffuser vanes, comprising;

an impeller including a hub and a plurality of blades and rotatably installed at a center of an interior of a casing;

a diffuser provided on an outer side of the impeller and configured to convert kinetic energy of fluid increased by rotation of the impeller into static pressure;

a rotating ring section provided on and configured to face an outer side of the diffuser in a ring shape and configured to be rotatable about the impeller;

a plurality of vanes disposed between an inlet side and an outlet side of the diffuser with respect to a flow of fluid, spaced apart from each other in a circumferential direction to define flow paths therebetween, and each configured to adjust an angle thereof to change an area of the flow path according to a moving direction of the vane; and a power transmitting section configured to generate power and transmit the power to the rotating ring section so that the rotating ring section is rotated about the impeller, wherein the vane comprises two hinge shafts formed at both ends thereof and a connecting portion connecting the hinge shafts, and at least a part of the connecting portion is made of a ductile material so that a length of the connecting portion elastically varies.

2. The centrifugal turbo machine of claim 1, wherein the connecting portion has a closed loop structure that is elastically wound around the hinge shafts.

3. The centrifugal turbo machine of claim 1, wherein the vane further comprises a spacer inserted between and fixed to opposite sides of the connecting portion to uniformly maintain a distance between the opposite sides of the connecting portion.

4. The centrifugal turbo machine of claim 1, wherein one hinge shaft of the hinge shafts is rotatably fixed to the inlet side of the diffuser, and the other hinge shaft is rotatably fixed to the rotating ring section.

5. The centrifugal turbo machine of claim 1, wherein the power transmitting section comprises:

a step motor;

a first element provided on a motor shaft of the step motor;

a second element installed at one side of the rotating ring section and engaged with the first element to provide the rotating ring section with rotational power through an interaction with the first element; and a controller configured to control driving of the step motor.

6. The centrifugal turbo machine of claim 5, wherein the first element includes a pinion gear and the second element includes a rack gear.

* * * * *